US005782053A

United States Patent [19]

Arntjen

[11] Patent Number: 5,782,053

[45] Date of Patent: Jul. 21, 1998

[54] BEARING ELEMENT FOR SUPPORTING THE ROOF CLADDING OF A LIGHT-ADMITTING ROOF RIDGE

[76] Inventor: Gerd Arntjen, An Der Brücke 33-35, 26180 Rastede, Germany

[21] Appl. No.: 859,177

[22] Filed: May 20, 1997

[30] Foreign Application Priority Data

Aug. 28, 1996 [DE] Germany ..... 296 14 963.2

[51] Int. Cl.[6] ..... E04C 3/06

[52] U.S. Cl. ..... 52/731.9; 52/733.2; 52/737.6

[58] Field of Search ..... 52/DIG. 17, 731.7, 52/731.9, 733.2, 737.6, 740.4

[56] References Cited

U.S. PATENT DOCUMENTS

| | | | |
|---|---|---|---|
| 3,243,930 | 4/1966 | Slowinski | 52/731.9 X |
| 3,950,912 | 4/1976 | Lundberg et al. | 52/733.2 |
| 4,016,700 | 4/1977 | Blomstedt | 52/731.7 X |
| 4,986,051 | 1/1991 | Meyer et al. | 52/731.7 X |

*Primary Examiner*—Christopher Todd Kent
*Attorney, Agent, or Firm*—Collard & Roe, P.C.

[57] ABSTRACT

A bearing element is for supporting the roof cladding forming light permeable panels of a light-admitting roof ridge for barns and/or ancillary buildings. The bearing element has at least one supporting surface for supporting the roof cladding panel, which supporting surface has a corrugated profiling at least in one surface area section.

3 Claims, 1 Drawing Sheet

BEARING ELEMENT FOR SUPPORTING THE ROOF CLADDING OF A LIGHT-ADMITTING ROOF RIDGE

BACKGROUND OF THE INVENTION

1. Field of the Invention

The present invention relates to a bearing element for supporting the roof cladding forming light permeable panels of a light admitting roof ridge for barns and/or ancillary buildings.

2. The Prior Art

An example of a bearing element of this type can be found, for example, in German Utility Model 93 16 045.3.

This utility model is concerned with problems which may occur in the region of a bearing element when two mutually adjacent panels which form the roof cladding of a light admitting roof ridge butt against one another above such a bearing element, forming a vertical joint in the process.

For constructing a light admitting roof ridge, plastic twin wall panels are usually used because they are virtually as transparent as glass, are lightweight and are relatively cost-effective.

If such a panel is positioned on a bearing element known from the prior art, this bearing element will form the roof rafter in this region. As a result, there may be particular problems with moisture, as has already been described in the above-cited German Utility Model 93 16 045.3. In particular, moisture can collect between the bearing element, namely the supporting surface of this element for the roof cladding panel, and the roof cladding panel itself. It is known that even if there is just a small quantity of liquid between two surfaces, that a thin stubbornly adhering film can form. This liquid which evaporates only with difficulty will wet these surfaces and will cling to both surfaces. This very effect is utilized, for example in a microscope, between the slide and the cover glass.

If such a film of liquid has collected between a roof cladding panel and the supporting surface of a bearing element, it is true that this liquid does not usually result in corrosion. This is because the corresponding bearing elements are usually manufactured from aluminum. However, this liquid may adversely affect the light permeability of the corresponding roof cladding panel. This is because the liquid may flow through the open borders of a twin-wall panel, into the interior of the panel, and thus into the chambers adjacent to the webs, and collect there. As a result of this liquid coating, the corresponding panel may lose its transparency over quite a large expanse of its surface area, with an unsightly effect.

SUMMARY OF THE INVENTION

It is an object of the present invention to provide a bearing element for supporting the roof cladding forming light permeable panels of a light admitting roof ridge, such that it is more difficult for liquid to collect in the region of the bearing element.

This object is achieved according to the invention in that the bearing element according to the invention has at least one supporting surface for supporting the roof cladding panels, which supporting surface has a profiling, preferably comprising corrugations which extend in the longitudinal direction of the bearing element and which are essentially parallel to one another, at least in one surface area section.

These corrugations may, in particular, be dimensioned and spaced apart from one another so as to produce an essentially wave-like pattern of corrugations on the supporting surface in this region. The waves or corrugations run essentially in the longitudinal direction of the bearing element. In contrast, the webs of the roof cladding forming twin wall panels usually run transversely with respect to the longitudinal direction of the bearing elements, that is to say essentially parallel to the ridge line of the light admitting roof ridge.

The webs provided at regular spacings in the twin wall panel likewise produce corrugations on such twin wall panels, usually on the outer surfaces thereof. This is because the plastic material of which the panel surfaces are made frequently curves slightly into the regions of the chambers between the webs, while being kept apart at a corresponding spacing by the webs themselves.

When the roof cladding panel is positioned on a bearing element according to the invention, the profiling of this bearing element produces point support by the corrugations or support by the mutually intersecting waves of the corrugations. This will ultimately also produce only point support in the supporting region. A certain clearance will remain between these supporting points in each case, and this clearance will make it easier for liquid to evaporate and also to flow away. This will make it more difficult for films of liquid to collect. At the same time, a higher surface pressure is produced in the region of the reduced supporting surface, and a better fluid tightness is achieved to prevent leakage in these regions. A preferred corrugation is a "round" wave formation which ensures, in addition, better pushing and pulling movement of the roof cladding panels, for example, in the event of thermal expansion or thermal contraction.

In this context, "round" wave formation is intended to mean that the cross-section of a respective wave or of a respective wave trough of this wave formation largely follows the path of a semicircle.

Another embodiment of the invention provides that the bearing element has in each case two supporting surfaces in this region at the border of one of its outer surfaces. These supporting surfaces come into use, independently of one another, in particular when mutually adjacent roof cladding panels butt against one another above this bearing element and find their own supporting surfaces in each case in the border regions of the bearing element.

In accordance with a further embodiment of the bearing element according to the invention, the outer surface of the bearing element which has the supporting surfaces has, between the supporting surfaces, a channel-like depression which extends in the longitudinal direction of the bearing element. This channel-like depression separates the two provided supporting surfaces from one another. At the same time, this channel-like depression permits, for example, flowing away of any liquid which can possibly collect in this region, and in particular, collect beneath a vertical joint region formed by two mutually adjacent roof cladding panels. However, such vertical joint regions are usually sufficiently protected against entering and collecting liquid by cover panels and seals, as is also disclosed by German Utility Model 93 16 045.3. However, it can occasionally happen that a corresponding cover panel may develop leaks or that liquid may flow out of the chambers of a twin wall roof cladding panel. Such liquid will flow into the channel of the bearing element according to the invention and will no longer be capable of entering and collecting in other chambers of the roof cladding.

In order to make it easier to install corresponding sealing covers, flanges or the like, the bearing element of the invention on its outer surface, which is intended to face the roof cladding, is preferably provided with a guide groove. This guide groove runs essentially centrally in the longitudinal direction of the bearing element. This guide groove makes it easier, for example, to place or position fastening screws with self-tapping threads. This guide groove may be, for example, a relatively simple indent in the material of the bearing element.

For reasons of cost and weight, the bearing element is preferably of an essentially hollow construction. The channel-like depression can thus be created relatively simply by a deformation of the material of the corresponding wall in this region. In this case, it is not at all to be inferred that it is first necessary at all to produce a bearing element with a smooth outer wall which is subsequently deformed. Rather, it is possible to produce from the outset a correspondingly extruded bearing element having the desired profile.

In another embodiment when the bearing element is preferably constructed as a U-shaped profile, or inverted U-shaped profile, it may be extremely advantageous if the bearing element material comprising that wall which has the supporting surfaces is reinforced. This reinforcement is positioned at least over a wide section of the channel like depression, preferably centrally located, in the direction of the interior of the bearing element by a bead or the like. This bead considerably improves the stability of the bearing element as a whole. At the same time, this bead also overcomes the effect of the material possibly being weakened by a guide-groove indent. In addition, such a reinforcement provides greater depth for the thread portion of the fastening screws.

BRIEF DESCRIPTION OF THE DRAWINGS

Other objects and features of the present invention will become apparent from the following detailed description considered in connection with the accompanying drawing which discloses embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
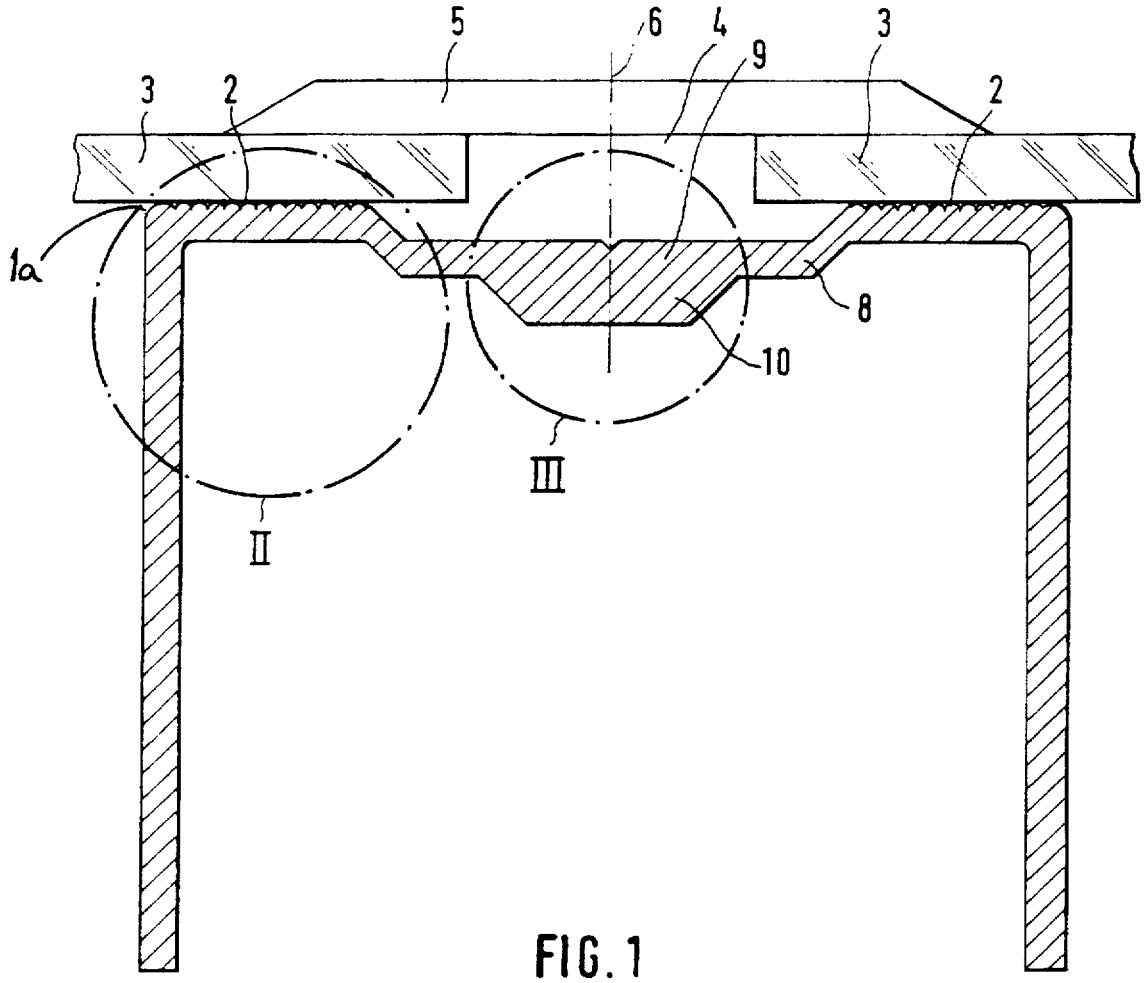
FIG. 1 shows a cross-section through a profile of a bearing element according to the invention.

Turning now in detail to the drawings, FIG. 1 shows a cross-section of a bearing element 1 according to the invention which is constructed as a U-shaped profile. The outer surface la of the base region of the profile provides two supporting surfaces 2 for roof cladding panels 3. FIG. 1 shows that the bearing element 1 has an inverted U-shape.

FIG. 1 illustrates two roof cladding panels 3, which are adjacent to one another above the bearing element 1, and between the supporting surfaces 2, form a vertical joint 4 as a result. The vertical joint 4 is covered essentially by a cover profile 5, which can be fastened along the axial center line 6, for example by means of a screw, in the base region of the bearing element 1. It is also possible, for example, for rubber seals or the like to be positioned between the cover profile 5 and the roof cladding panels 3. In this respect, the vertical joint region of the vertical joint 4 is illustrated only very schematically and in basic terms in this illustration.

Figure 2:
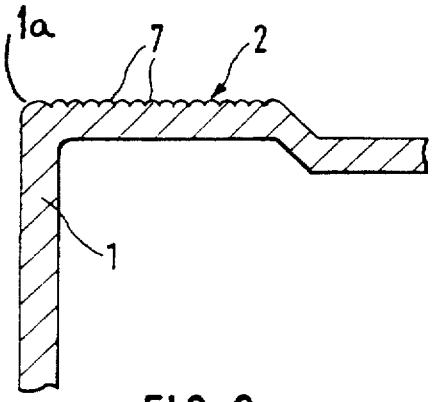
FIG. 2 shows an enlargement of the detail designated by II in FIG. 1.

FIG. 2 shows, in an illustration which is enlarged with respect to FIG. 1, the detail designated by II in FIG. 1. FIG. 2 shows essentially one supporting surface 2 of the bearing unit 1.

The supporting surface 2 includes mutually adjacent corrugations 7 which extend in the longitudinal direction of the bearing element 1. Corrugations 7 are essentially parallel to one another and together produce a wave formation in the supporting surface 2.

Figure 3:
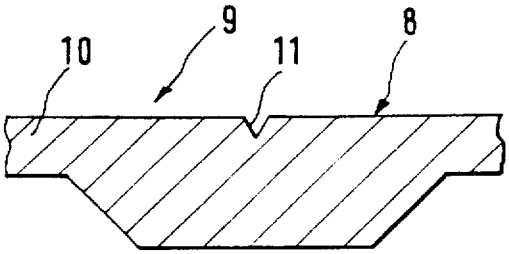
FIG. 3 shows an enlargement of the detail designated by III in FIG. 1.

FIG. 3 shows, in an illustration which is enlarged with respect to FIG. 1, the detail designated by III in FIG. 1.

FIG. 1 shows the wall 8 of the bearing element 1. This wall 8 is connected to the supporting surfaces 2, and has, between these supporting surfaces, a channel-like depression 9 which extends, beneath the vertical joint 4, in the longitudinal direction of the bearing element 1. A reinforcement bead 10 is provided on the inner side of the wall 8, in the central region of the channel-like depression 9. This bead reinforces the material of the wall 8 in this region and likewise extending in the longitudinal direction of the bearing element 1.

This bead 10 is illustrated in FIG. 3. FIG. 3 shows, moreover, that an indent 11 runs in the center of the channel-like depression 9. It is possible for the indent to serve as a guide groove for fastening screws which are to be drilled into the material of the wall 8 along the axial center line 6. Due to the size ratios, the indent 11 cannot be seen in precise terms in the illustration of FIG. 1.

While several embodiments of the present invention have been shown and described, it is to be understood that many changes and modifications may be made thereunto without departing from the spirit and scope of the invention as defined in the-appended claims.

What is claimed is:

1. A bearing element for supporting a roof cladding forming light permeable panels of a light admitting roof ridge for barns and ancillary buildings, comprising a bearing element having an outer surface with two supporting surfaces for supporting a roof cladding panel;

said supporting surface having a profiling on at least one section of this supporting surface;

wherein the profiling comprises corrugations which extend in a longitudinal direction of the bearing element and are parallel to one another; said corrugations are adapted to be in contact with said roof cladding panel;

wherein said outer surface of the bearing element which has said supporting surfaces has a channel like depression between the supporting surfaces; said channel like depression extends in a longitudinal direction of the bearing element;

wherein said outer surface is adapted to face said roof cladding, and in said outer surface is a guide groove which runs centrally in a direction of a longitudinal extent of said bearing element; wherein said guide groove is an indent in the bearing element; and wherein material of the wall is reinforced by a bead at least over a central section of the channel like depression, in an interior portion of the bearing element.

2. The bearing element as claimed in claim 1, wherein said bearing element is hollow; and wherein the channel-like depression is a deformation of material of the bearing element in a region of a wall which has a corresponding outer surface.

3. The bearing element as claimed in claim 2, wherein the bearing element is an inverted U-shaped profile, and the wall which has the supporting surfaces is a base of the U-shaped profile.

* * * * *